US006291788B1

(12) United States Patent
Doughty et al.

(10) Patent No.: US 6,291,788 B1
(45) Date of Patent: Sep. 18, 2001

(54) VENT SCREEN WITH REJECTION FEATURES

(75) Inventors: Dennis J. Doughty, Plainville; Randy Greenberg, Granby, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/603,977

(22) Filed: Jun. 27, 2000

Related U.S. Application Data

(60) Provisional application No. 60/190,455, filed on Mar. 17, 2000.

(51) Int. Cl.[7] ..... H01H 33/02; H01H 33/08

(52) U.S. Cl. ..... 218/156; 218/157

(58) Field of Search ..... 218/15, 34, 35, 218/76, 81, 149, 156, 157; 335/201, 202, 132; 200/293–308

(56) References Cited

U.S. PATENT DOCUMENTS 4,019,005 * 4/1977 Michetti ..... 218/154
5,811,749 * 9/1998 Bausch et al. ..... 218/157

* cited by examiner

*Primary Examiner*—Lincoln Donovan
(74) *Attorney, Agent, or Firm*—Canton Colburn LLP; Carl B. Horton

(57) ABSTRACT

A vent screen for a use in a circuit breaker cassette having structural characteristics that allows it to be assembled correctly within the circuit breaker cassette and where the vent screen allows for the flow of arc gases from the arc chambers.

4 Claims, 8 Drawing Sheets

VENT SCREEN WITH REJECTION FEATURES

CROSS REFERENCE TO RELATED APPLICATIONS

This application is based upon, and claims the benefit of, U.S. Provisional Patent Application No. 60/190455 filed on Mar. 17, 2000, which is herein incorporated by reference in its entirety.

BACKGROUND OF THE INVENTION

This invention relates generally to a circuit breaker, and, more particularly, to a circuit breaker cassette assembly.

Circuit breakers are one of a variety of overcurrent protective devices used for circuit breaker protection and isolation. The basic function of a circuit breaker is to provide electrical system protection whenever an electrical abnormality occurs in any part of the system. In a rotary contact circuit breaker, current enters the system from a power line. The current passes through a load strap to a stationary contact fixed on the strap and then to a moveable contact. The moveable contact is fixedly attached to an arm, and the arm is mounted to a rotor that in turn is rotatably mounted in a cassette. As long as the fixed contact is in physical contact with the moveable contact, the current passes from the fixed contact to the moveable contact and out of the circuit breaker to downline electrical devices.

In the event of an overcurrent condition (e.g. a short circuit), electro-magnetic forces are generated. These electro-magnetic forces repel the movable contact away from the stationary contact. Because the moveable contact is fixedly attached to a rotating arm, the arm pivots and physically separates the stationary and moveable contacts, thus tripping the unit. When the contacts are rapidly opened, as is the case during a trip caused by a short circuit event, an arc is produced. It is common practice to employ an arc chute assembly to extinguish this resultant arc.

Circuit breaker design, and more particularly, cassette design should enable the efficient and proper positioning of the various components, such as the rotor, arc chute assemblies and vent screens, into the cassette. For example, improper installation of a rotor into a cassette can result in the two cassette half pieces not mating correctly together. Also, care must be taken to ensure that an arc chute assembly is correctly positioned into the cassette. This ensures proper rotation of the moveable contact arm as well as the proper spacing between the moveable contact and the plate closest to the moveable contact. Improper installation of a rotor, an arc chute assembly or a vent screen into a cassette half piece will require disassembly and reassembly of the cassette. Such disassembly and reassembly is time consuming and can increase the production cost of the circuit breaker.

BRIEF SUMMARY OF THE INVENTION

A vent screen for a use in a circuit breaker cassette having structural characteristics that allows it to be assembled properly within the circuit breaker cassette to allow for the flow of arc gases from the arc chambers, the vent screen comprising a vent portion where the vent portion comprises a plurality of apertures, and the vent screen comprising a tab portion extending from an edge of the vent portion.

DETAILED DESCRIPTION OF THE INVENTION

Figure 1:
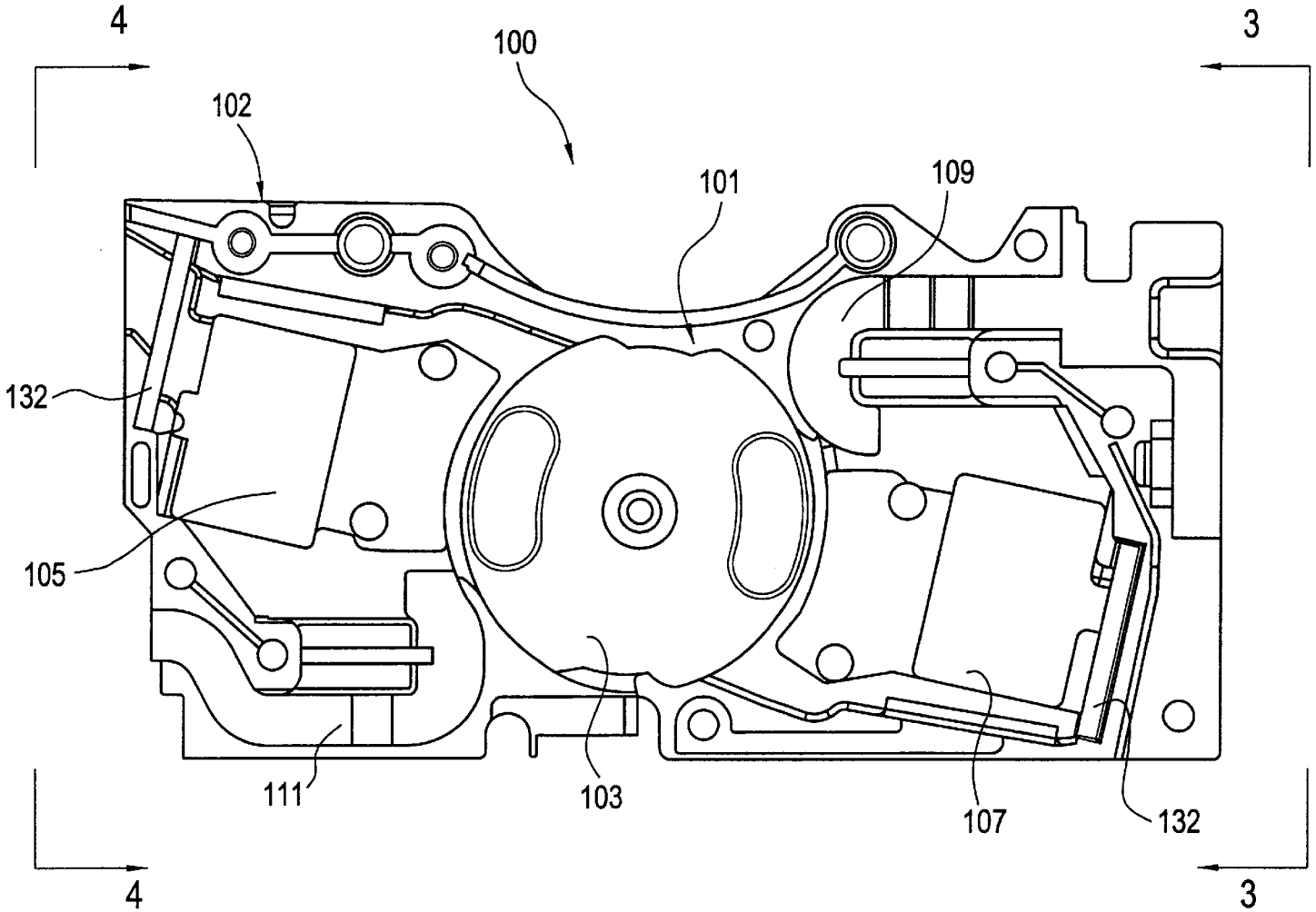
FIG. 1 is a side view of a right half cassette piece of the circuit breaker cassette.

Referring to FIG. 1, a right half cassette piece 102 of a circuit breaker cassette 100 is generally shown. The circuit breaker cassette 100 is generally comprised of the right half cassette piece 102 and a left half cassette piece 104 (FIG. 2) secured together by suitable fastening means. The right half cassette piece 102 comprises an inner surface 101 having a rotor recess 103 formed on the inner surface 101, and arc chute recesses 105 and 107 formed on the opposite ends of the rotor recess 103. A load-side contact strap recess 109 and a line-side contact strap recess 111 is also formed on the inner surface 101 of the right half cassette piece 102 proximate the arc chute recesses 105 and 107. The contact strap recesses 109 and 111 each house a corresponding line-side contact strap and a load-side contact strap therewithin. Moreover, grooves 132 formed on the inner surface 101 of the right half cassette piece 102 are disposed for accepting a vent screen 110 (FIG. 3). Generally, the line-side contact strap is electrically connected to line-side wiring (not shown) in an electrical distribution circuit, and the load-side contact strap is electrically connected to load-side wiring (not shown) via a lug (not shown) or some device such as a bimetallic element or current sensor (not shown). The circuit breaker cassette 100 includes a rotary contact arm therein for passage of current when rotary contact arm is closed and for preventing passage of current when the contact arm is opened.

Figure 2:
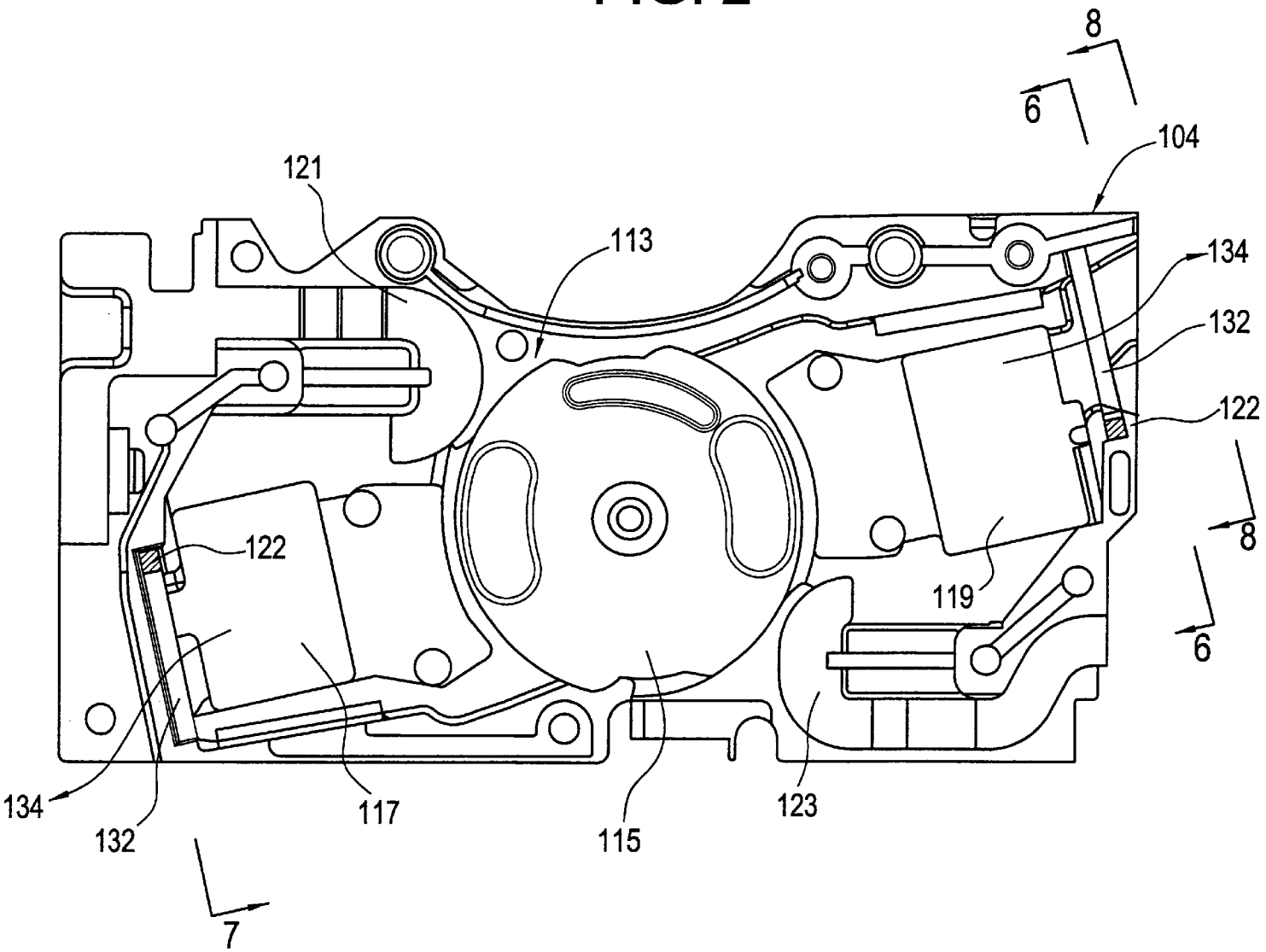
FIG. 2 is a side view of a left half cassette piece of the circuit breaker cassette.
Figure 3:
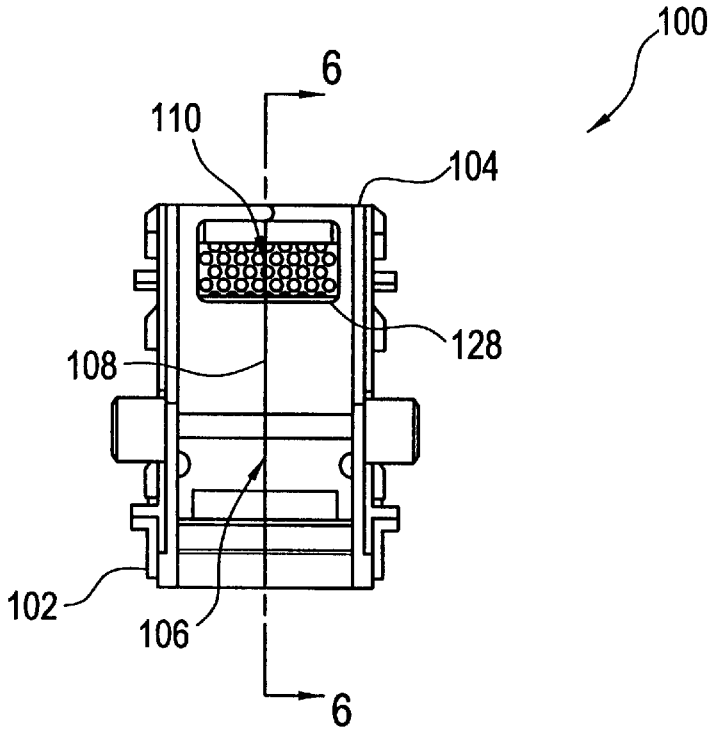
FIG. 3 is a first side view of the circuit breaker cassette.

Referring to FIG. 2, a left half cassette piece 104, which all the features described in the right half cassette piece 102 are mirrored therewithin and are substantially similar, is illustrated. The left half cassette piece 104 comprises an inner surface 113 having a rotor recess 115 formed on the inner surface 113, and arc chute recesses 117 and 119 formed on the opposite ends of the rotor recess 115. A load-side contact strap recess 121 and a line-side contact strap recess 123 is also formed on the inner surface 113 of the left half cassette piece 104 proximate the arc chute recesses 117 and 119 housing a line-side contact strap and a load-side contact strap respectively therewithin. Moreover, grooves 132 formed on the inner surface 113 of the left half cassette piece 104 are disposed for accepting a vent screen 110.

Generally, electrical transport through the circuit breaker interior proceeds from the line-side contact strap to associated first fixed and first movable contacts at one end of a movable contact arm, to first fixed and first movable contacts at the opposite end thereof, to the associated load-side contact strap. The movable contact arm moves in unison with the rotor upon manual articulation of the circuit breaker operating mechanism to drive the first and second movable contacts between closed and open positions. The arc chutes disposed within the arc chute recesses between the left half cassette piece 104 and right half cassette piece 102 are adapted to extinguish the arc which forms when the circuit breaker is tripped and the first and second moveable contacts are suddenly separated from the first and second fixed contacts.

Moreover, the arc causes the formation of relatively high pressure gases as well as ionization of air molecules within the arc chutes. The gases therefore must be kept separate until the ionization has dissipated and the temperature of the gases has moderated. An exhaust port is conventionally employed to vent such gases in the circuit breaker since such gases are deleterious to electrical components. Therefore, the vent screen 110 is utilized to properly direct the flow of the arc gases from the arc chutes to the outside. The vent screen 110 design allows for correct assembly of the right half cassette piece 102 and the left half cassette piece 104 together to ensure proper insulation along their contacting edges and tightly seal the arc chambers where the arc gases cannot flow inside the circuit breaker cassette 100.

Figure 4:
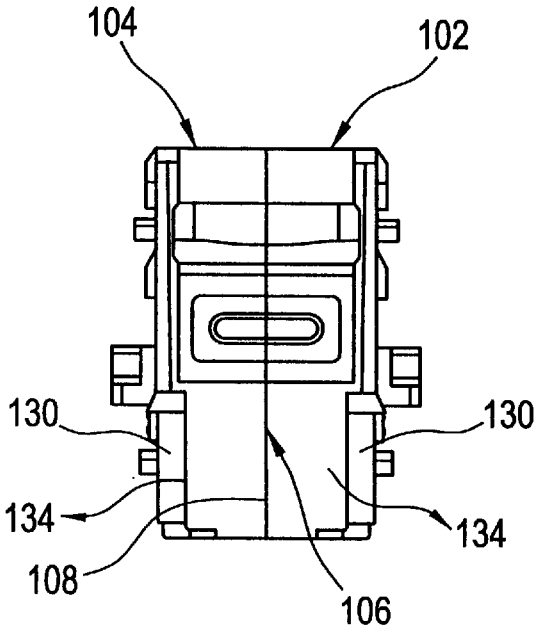
FIG. 4 is a second side view of the circuit breaker cassette.

Referring to FIG. 3 and FIG. 4, the right half cassette piece 102 and the left half cassette piece 104 of the circuit breaker cassette 100 are attached together to complete an enclosure wherein the common face 106 creates a seam 108 along the contact line between the two halves. The aforesaid joining of the right half cassette piece 102 and the left half cassette piece 104 defines a window 128 at one end of the circuit breaker cassette 100, and a vent channel 130 at the opposing end of circuit breaker cassette 100 (FIG. 2). The window 128 and the vent channel 130 allow for the passage of the arc gases therethrough from the corresponding arc chute. For the arc gases to be properly vented out and not flow within the circuit breaker cassette, the two left and right half cassette pieces 102 and 104 must be attached tightly to one another along the common face 106 wherein the seam 108 is created. One method of doing that is to ensure that the vent screen 110 corresponding with the load-side arc chute and the vent screen 110 corresponding with the line-side arc chute are properly installed and not upside down during the assembly of the circuit breaker cassette 100.

Figure 5:
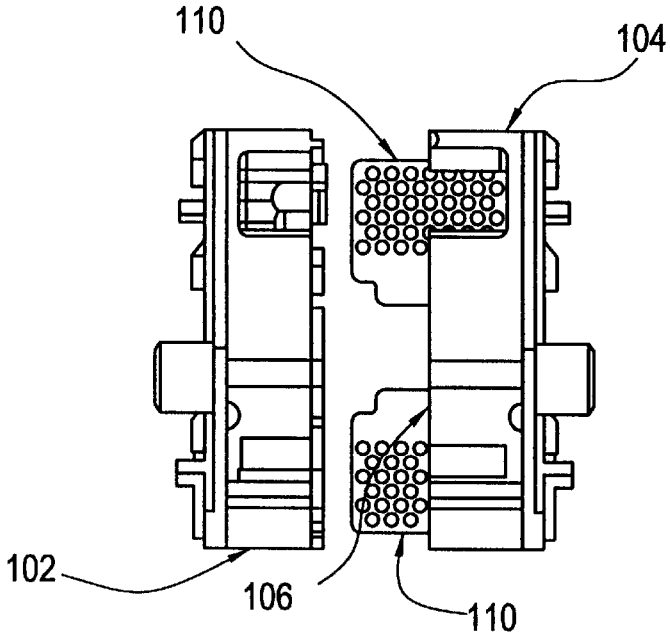
FIG. 5 is the side view of FIG. 3 showing the right half cassette piece and the left half cassette piece of the circuit breaker cassette separated along a common face.
Figure 6:
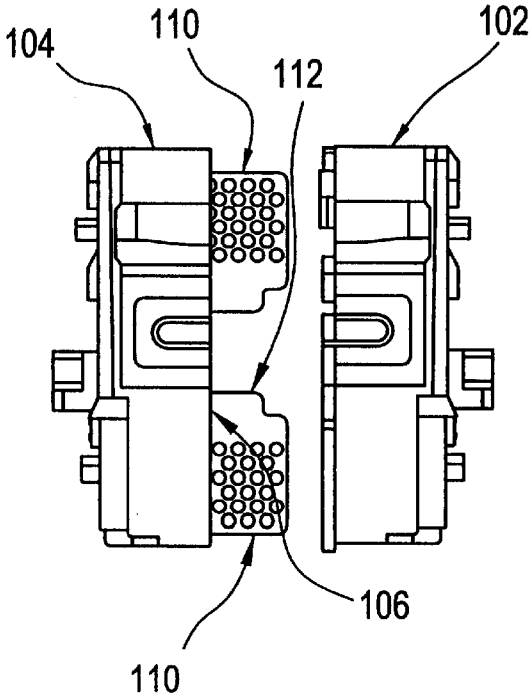
FIG. 6 is the side view of FIG. 4 showing the right half cassette piece and the left half cassette piece of the circuit breaker cassette of FIG. 1 separated along a common face.

Referring to FIG. 5 and FIG. 6, the vent screens 110 are illustrated prior to being positioned between the left half cassette piece 104 and the right half cassette piece 102. Since the vent screens 110 are to be positioned prior to the assembly of the circuit breaker cassette 100, the vent screen 110 for the load-side end and the vent screen 110 for the line-side end must be correctly positioned between the cassette halves to allow for a perfect enclosure of the circuit breaker cassette 100. As will be described herein, the structural characteristics of the vent screen 100 inhibit incorrect positioning of the vent screens 110 within the circuit breaker cassette 100.

Figure 7:
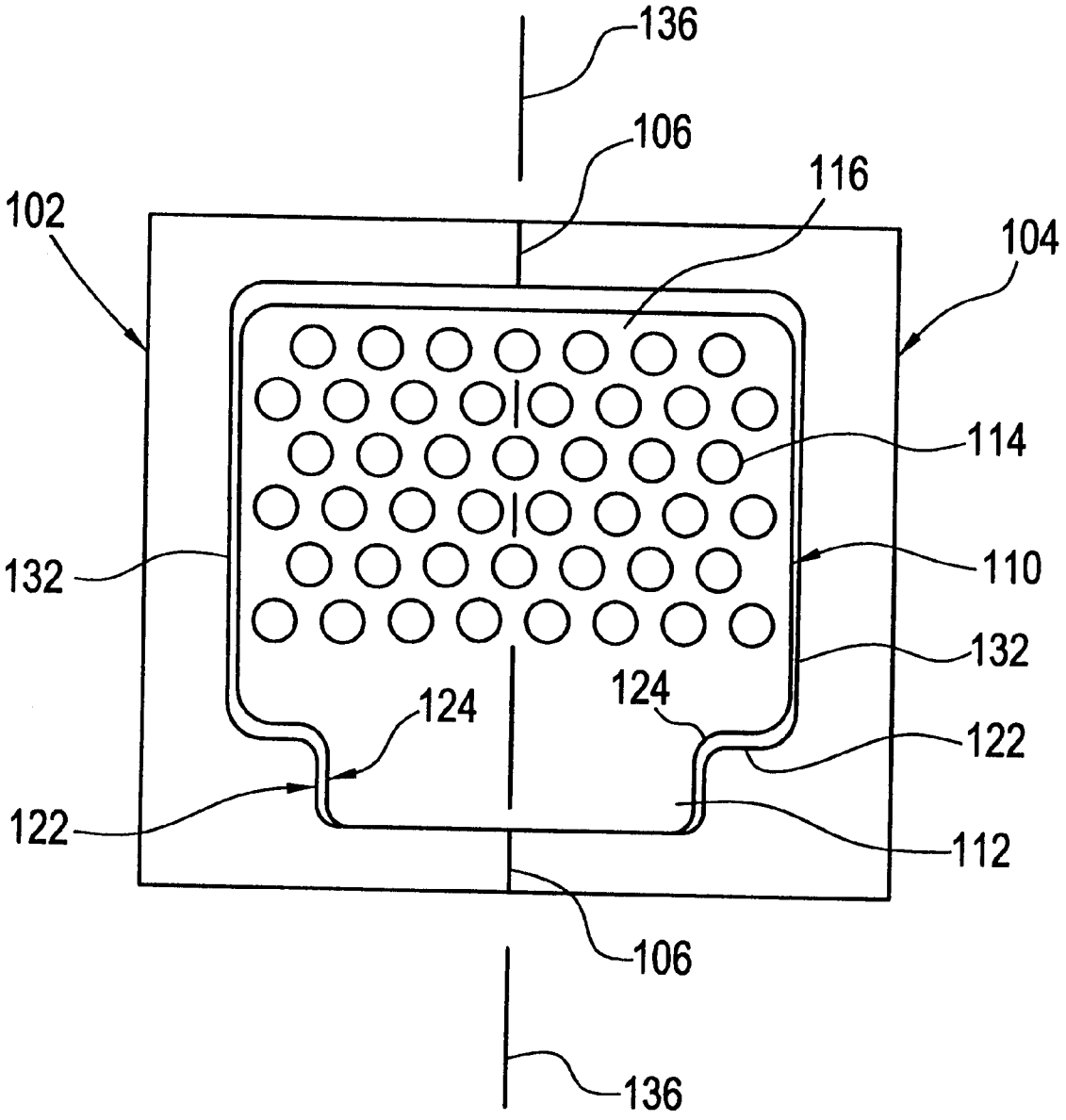
FIG. 7 is a first sectional view of a vent screen taken along the line 6—6 in FIG. 2.
Figure 8:
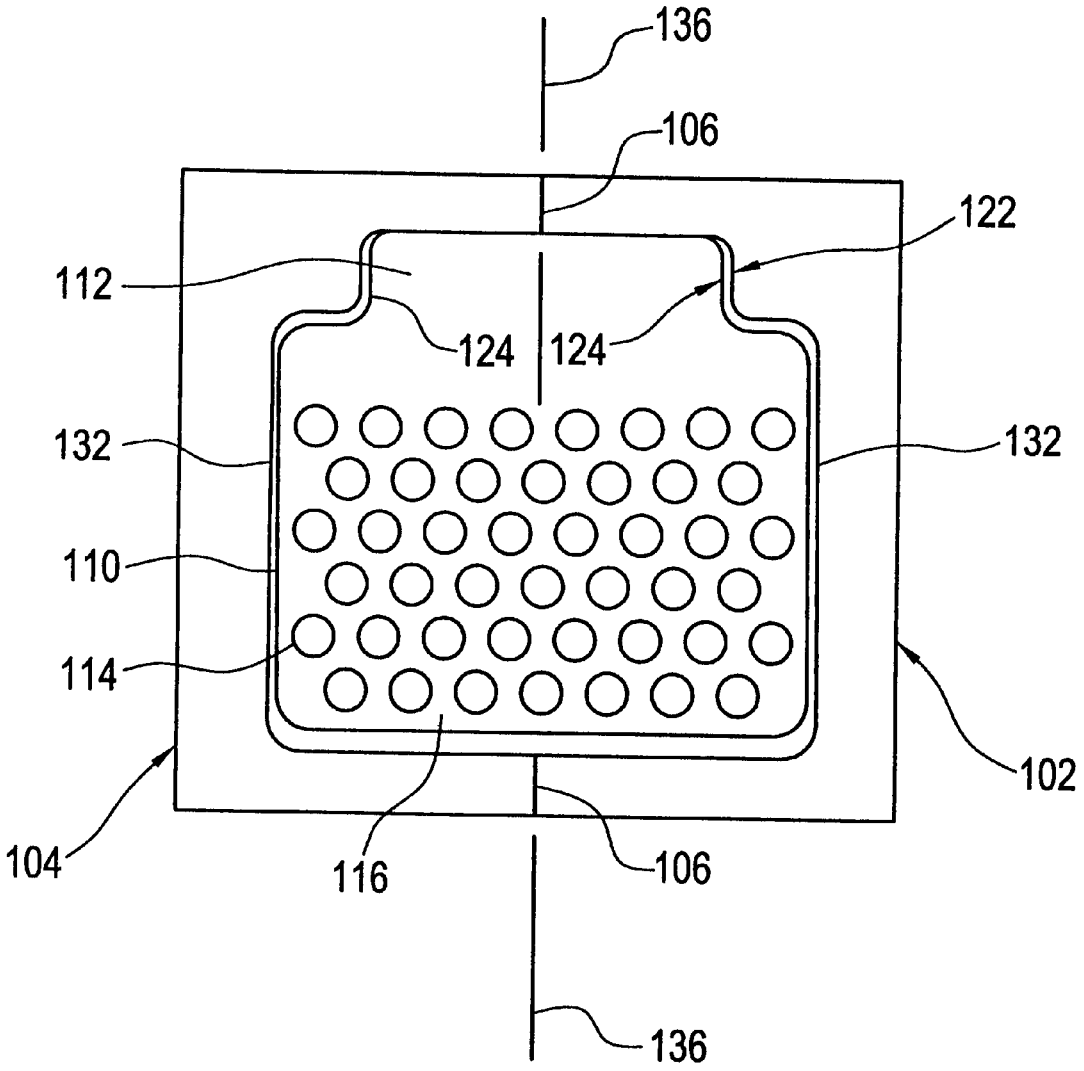
FIG. 8 is a second sectional view of a vent screen taken along the line 7—7 in FIG. 2.
Figure 10:
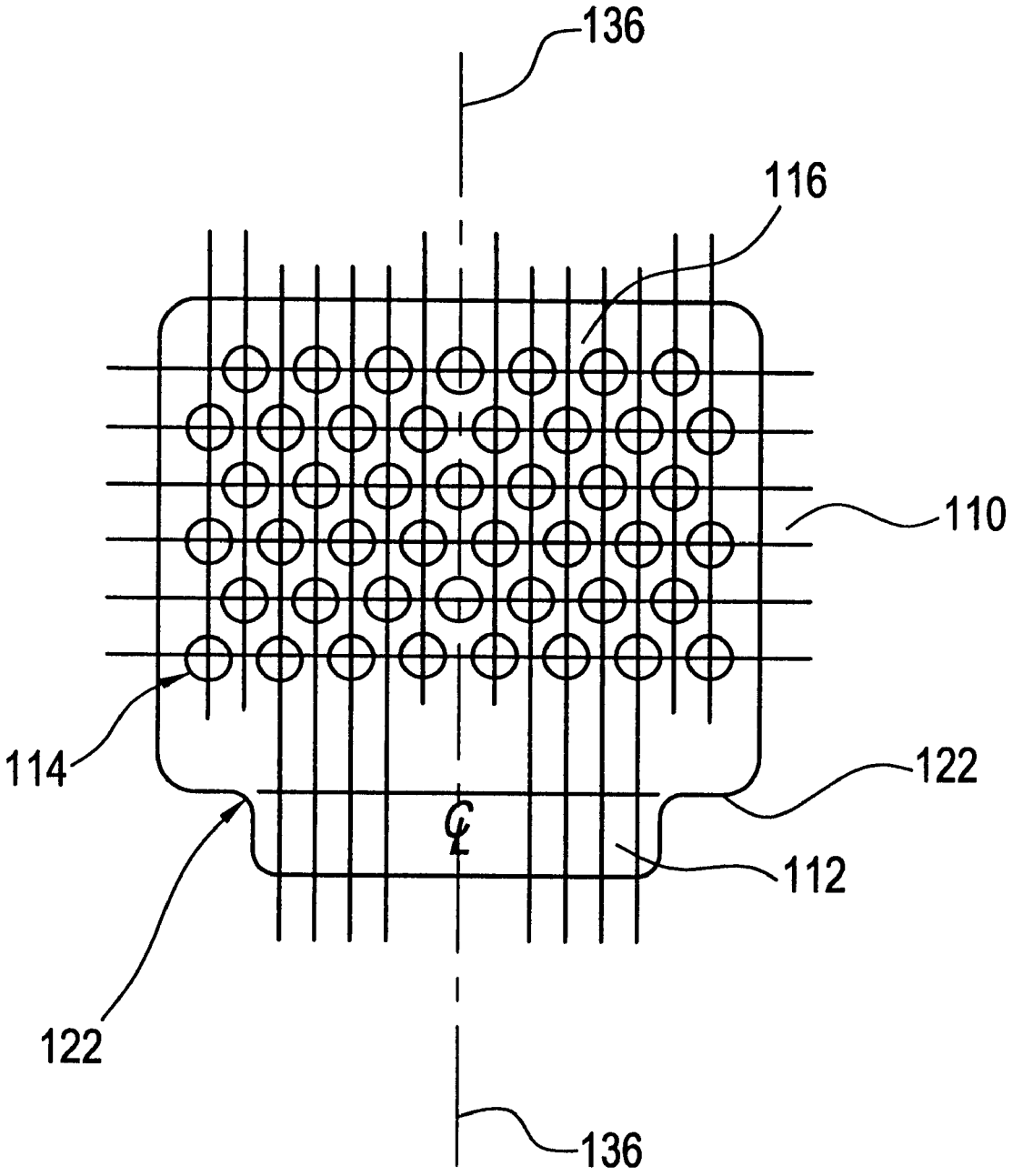
FIG. 10 is a perspective view of a vent screen having a sieve like structure.

Referring to FIG. 7 and FIG. 8, the vent screen 110 is illustrated in greater detail. It should be appreciated that the vent screen 110 for the line-side contact (FIG. 7) is substantially similar to the vent screen 110 for the load-side contact (FIG. 8). The vent screen 110 generally comprises a tab portion 112 and a vent portion 116. The vent portion 116 generally comprises a plurality of apertures 114 such as, but not limited to, circular cross section holes which allow for the arc gases to flow therethrough. The tab portion 112 is preferably a solid portion of the vent screen 110 and joined to the vent portion 116 so as to form a contiguous whole. Moreover, the apertures 114 are preferably arranged in an essentially matrix fashion creating a sieve like structure (FIG. 10). The apertures 114 are operative to allow the free flow of gases therethrough as seen in reference numeral 134 (in FIG. 2) from the arc chute, while the tab portion 112 is operative to impede the flow of gases, thus preventing the flow of the gases through the seam 108.

The vent screen 110 is captured in the groove 132 of the right half cassette piece 102 and the left half cassette piece 104 of the circuit breaker cassette 100. The tab portion 112 of the vent screen 110 further comprises shoulders 124 which are non-compatible with a knee 122 of the right and left half cassette pieces 102 and 104. Such incompatibility of the knee 122 and the shoulder 124 prevents the inadvertent rotation of the vent screen 110 about the axis 136 during assembly of the circuit breaker cassette 100. The narrower nature of the tab portion 112 of the vent screen 110 in contrast to the wider vent portion 116 thereof prevents misassembly of the circuit breaker cassette 100 whereby the vent portion 116 and the tab portion 112 may be inverted, or the vent screen may be placed in the groove 132 sideways.

Figure 9:
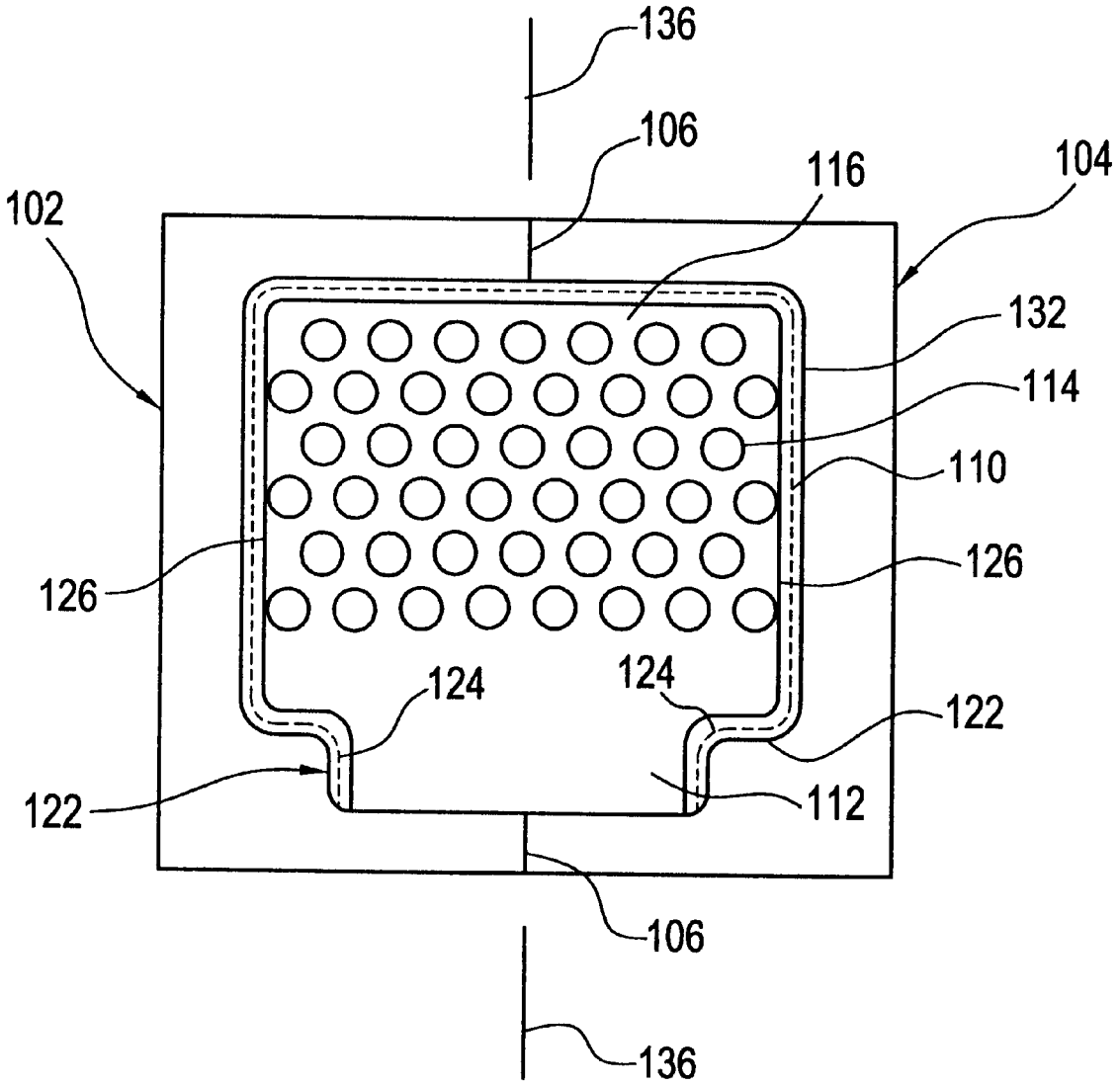
FIG. 9 is a third sectional view of a vent screen taken along the line 8—8 in FIG. 2.

Referring to FIG. 9, a lip 126 is illustrated extending from the right and left half cassette pieces 102 and 104 of the circuit breaker cassette 100. The lip 126 is operative to aid in seating the vent screen 110 in the groove 132 and to impede the flow of gases therethrough.

The vent screen 110 described herein prevents misassembly of the vent screens within a circuit breaker cassette and therefore, helps to eliminate lost time and effort needed to correct misassembled circuit breaker cassettes.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but rather that the invention will include all embodiments falling within the scope of the appended claims.

What is claimed is:

1. A circuit breaker cassette comprising:

a right half cassette piece having a first groove with a first knee at one end thereof;

a left half cassette piece having a second groove with a second knee at one end thereof and said left half cassette piece attaches to said right half cassette piece and said first groove aligns with said second groove and said first knee is adjacent said second knee;

an arc chute disposed between said right and left cassette piece; and a screen captured in said groove and between said right half and left half cassette pieces and disposed at an outlet opening of said arc chute, said screen comprising a vent portion, said vent portion comprises a plurality of apertures, and a tab portion contiguous with and extended from an edge of said vent portion;

wherein said tab portion engages between said first knee and said second knee and said apertures of said vent portion align with said outlet opening when said right half cassette piece attaches with said left half cassette piece and a width of said vent portion is larger than a width of said tab portion to prevent said vent portion to engage between said first knee and said second knee when said right half cassette piece attaches with said left half cassette piece.

2. The circuit breaker cassette recited in claim 1 wherein said tab portion and said vent portion are made of one piece creating a contiguous whole.

3. The circuit breaker cassette recited in claim 1 wherein said plurality of apertures have a circular cross-section.

4. The circuit breaker cassette recited in claim 1 wherein said plurality of apertures are arranged in a matrix fashion creating a mesh.

* * * * *